US005113611A

United States Patent [19]

Rosson

[11] Patent Number: 5,113,611

[45] Date of Patent: May 19, 1992

[54] EXPANDABLE SCREEN TENSIONING FRAME WITH EXPANSION DEVICES

[76] Inventor: Gene T. Rosson, 742 E. Lowell St., Lakeland, Polk County, Fla. 33805

[21] Appl. No.: 694,097

[22] Filed: May 11, 1991

[51] Int. Cl.[5] ..... D06C 3/08; B05C 17/08

[52] U.S. Cl. ..... 38/102.7; 38/102.8; 160/374.1; 160/381; 160/378; 101/127.1

[58] Field of Search ..... 38/102, 102.1, 102.3-102.5, 38/102.7, 102.8, 102.91; 160/374.1, 378, 380, 381, 392, 395; 101/127.1, 415.1

[56] References Cited

U.S. PATENT DOCUMENTS

| | | | |
|---|---|---|---|
| 119,507 | 10/1871 | Crocker et al. | 160/374.1 |
| 1,916,023 | 6/1933 | Shull | 160/374.1 |
| 2,037,757 | 4/1936 | Borntraeger | 38/102.3 |
| 3,211,089 | 10/1965 | Messerschmidt | 160/378 X |
| 3,448,551 | 6/1969 | Heller | 160/374.1 X |
| 3,482,343 | 12/1969 | Hamu | 38/102.5 |
| 3,600,746 | 8/1971 | Kostur | 38/102.5 X |
| 3,914,887 | 10/1975 | Newman | 38/102.8 |
| 3,924,343 | 12/1975 | Johnson | 38/102.1 |
| 4,144,660 | 3/1979 | Lamb | 38/102.5 |
| 4,301,853 | 11/1981 | Vidal | 160/374.1 |
| 4,452,138 | 6/1984 | Bubley et al. | 160/381 X |
| 4,539,734 | 9/1985 | Messerschmitt | 38/102.91 |
| 4,565,020 | 1/1986 | Beatriz et al. | 38/102.5 |
| 5,052,462 | 10/1991 | Stobart | 38/102.5 X |

FOREIGN PATENT DOCUMENTS

| | | | |
|---|---|---|---|
| 2376002 | 7/1978 | France | 38/102.4 |
| 0126170 | 6/1928 | Switzerland | 38/102.8 |

*Primary Examiner*—Werner H. Schroeder
*Assistant Examiner*—Ismael Izaguirre
*Attorney, Agent, or Firm*—Arthur W. Fisher, III

[57] ABSTRACT

A tensioning apparatus for stretching screen fabric or other membrane comprising an expandable tensioning frame to operatively support the screen fabric or other membrane cooperatively formed by a plurality of frame members and a corresponding plurality of corner members, and at least one expansion or tensioning tool to selectively expand the expandable tensioning frame to stretch the screen fabric or other membrane thereon.

14 Claims, 5 Drawing Sheets

EXPANDABLE SCREEN TENSIONING FRAME WITH EXPANSION DEVICES

BACKGROUND OF THE INVENTION

1. Field of the Invention

A tensioning apparatus for stretching screen fabric or other membrane.

2. Description of the Related Art

Serigraphy or silk screening is a process for producing an image on a working surface such as a sheet of paper with the aid of a stencil. The process involves stretching screen fabric on a frame and applying a stencil on the screen fabric conforming to the areas not to be colored in the final image. The screen fabric is laid adjacent the image receiving piece or substrate such as paper, metal, wood, plastic, masonry, cloth or bristol board and the desired pigment is applied across the screen fabric. The pigment penetrates those areas of the screen fabric not covered by the stencil to produce the desired image on the image receiving piece.

Various frames for stretching the screen material have included simple frames, roller frames, draw bar frames and expansion frames.

Numerous prior art methods include using a generally rigid wood frame and merely pulling the fabric over the frame and then fastening the fabric in place by tacks, staples or adhesive Another prior art method has been to provide a frame member with wedge means adapted to be driven into each corner of the frame to create the tension on fabric material secured to the frame. This method does not permit effective further adjustment of the tension on the material after the tension has once been applied by the wedge means. In addition, it is difficult to control the initial tension on the material because of the inability to control the tension on each of the four corners of the frame equally.

Another prior art method has been to use a metallic type frame and secure fabric material thereto by means of a groove in the metallic frame. Tightening of the fabric material is accomplished by expanding each of the telescopically disposed corners creates the tension on the material.

Specific examples of such devices are found in a number of United States patents.

U.S. Pat. No. 4,430,815 shows a fabric tension apparatus for screen printing frames wherein the edge portions of a screen fabric are attached to a screen printing frame. The frame has discrete springs in contact with the fabric. The springs provide limited movement of the fabric toward a substrate by deformation of the springs instead of relying only on stretching of the fabric.

U.S. Pat. No. 3,601,912 teaches a frame for supporting and stretching a rectangular printing screen comprising a plurality of frame members connected by and journaled within corner members. The frame members have means for gripping the screen material along each edge and are rotatable within the corner members to apply tension to the screen to create the desired tension.

U.S. Pat. No. 4,525,909 discloses a screen tensioning and printing frame including sets of parallel rollers coupled to corner members. Each roller has a longitudinally extending peripheral fabric locking groove defined in part by straight surfaces. Adjacent and on opposite sides of the locking groove is at least one fabric registration groove on the periphery of each roller.

U.S. Pat. No. 3,908,293 shows a screen tension and printing frame including sets of parallel rollers wherein each roller is coupled to an edge portion of a screen. The screen is in sealing contact with a dam member located inwardly of the rollers. Each roller is provided with means to facilitate selective rotation and locking of each roller in a position so that a desired tension may be applied to the screen.

U.S. Pat. No. 4,409,749 teaches a stretch frame for sheet material such as printing screen utilizing tensioning rollers to be secured to the sheet edges and then rotated to stretch the sheet material. The rollers may be rotatably received within laterally opening channels in the frame and restrained against reverse rotation to release the sheet tension by a ratchet device extending along a substantial length of each roller.

U.S. Pat. No. 3,482,343 discloses a stretch frame for stressing sheet material such as printing screen. In mutually perpendicular edgewise directions, the frame includes frame members and floating bars for attachment to the edges of the sheet material to be stressed, and means independently adjusting the frame members and floating bars to stretch the sheet material in the edgewise direction in such a way as to permit both coarse and fine adjustments of the sheet tension.

U.S. Pat. No. 3,924,343 teaches a frame for stretching material secured thereto comprising elongated defining frame elements having mitered ends adapted for juxtapositioning with the confronting end of an adjacent frame element with rotatable stud means coacting between adjacent frame elements coupling the latter together and providing for movement of the coupled frame elements relative to one another upon rotation of the stud means to stretch the material attached to the frame.

U.S. Pat. No. 3,485,165 shows a silk screening frame having longitudinal and transverse frame members defining a central well with a silk screen stretched across the bottom of the well and through which pigment may be pressed to form a given design. Each frame member has a slide guided thereby for movement toward and away relative to the well. Each slide includes a groove for receiving the adjacent marginal edge the screen formed with converging fingers into which an anchor pin is inserted to hold the screen to the guide. The slides are guided relative to their respective frame members so that the slides are prevented from twisting out of alignment.

U.S. Pat. No. 4,442,772 discloses a stencil frame enclosed tightly by a pneumatically operated frame. Once the stencil frame is enclosed, the pneumatic tensioning frame is inflated pulling a screen fabric outwardly to stretch the screen fabric with movement of the frame members and frame supporting portion of the tensioning frame so that the top wall of the frame member is pushed tightly and intimately against the underside of the screen fabric.

U.S. Pat. No. 3,541,957 teaches a stretcher device enclosed tightly by a pneumatically operated frame. The stencil screen is secured on all sides by the movable portions of the surrounding pneumatic tensioning frame. The pneumatic tensioning frame is then inflated uniformly with compressed air and extended to cause the screen to be tensioned uniformly in all directions. The screen is then tacked or stapled or otherwise fastened to the stencil frame. The pneumatic frame comprises a plurality of pneumatically operated frame members having a fixed member engageable with the stencil frame and a movable member on which the stencil screen is secured for movement under penumatic pressure. The pneumatic frame members are provided with connection means for assembling the individual frame members end to end or at right angles to provide a rectangular frame enclosure of any desired size in which the movable frame member is adapted to move under pneumatic pressure to tension a screen stencil in all directions uniformly and continuously around the periphery of the stencil frame.

U.S. Pat. No. 3,991,677 discloses a printing screen and tensioning means including a rigid frame structure formed of channel shaped side members joined at the corners of the frame structure. The underside of each frame member receives a parallelogram structure having a first and second side member connected by pivot links. The first side member is disposed adjacent the inner margin of the frame member and longitudinally movable by a screw drive; while, the second side member is guided for transverse movement in the frame member to and from the first member and having continuous screen attachment means. The printing screen includes a continuous clip element at each side received on the attachment means whereby upon operation of the screw drives the second side member applying a laterally outward force for uniformly stretching a corresponding side of the printing screen.

U.S. Pat. No. 4,451,997 shows an embroidery hoop style stretcher frame for stretching and holding fabric during stitching and/or painting. The stretcher frame includes a first frame member with an outer rectangular U-channel portion and a second frame member having an inner rectangular U-channel portion which fits matingly within the outer U-channel portion of the first frame member so that fabric may be sandwiched between the inner and outer U-channel portions.

U.S. Pat. No. 4,860,467 teaches a method of tensioning screening material on a tension frame for use in a silk screen process including the steps of squaring the material, attaching the material to rotatable frame members along a portion of their length by adhesive, rotating the frame members until the appropriate tension is reached and securing the frame members in position. The fabric may be retensioned without removal. The frame includes four rotatable cylindrical elements including a plug at each end which has a plurality of radial bores for rotation by a spanner wrench.

U.S. Pat. No. 3,422,554 shows a frame for stretching screen for use in serigraphic processes. The frame comprises a plurality of support members defining a periphery. Clamp means comprising a first and a second clamp member and a securing means therebetween is attached to at least one of the support members by an adjustment means. The screen to be stretched is placed within the periphery defined by the support members and sandwiched between the securing means and the clamp members. An opposite margin of the screen is secured to an opposite support member and the adjustment means is operated to provide adjustment of the position of the assembled clamp means thereby providing adjustment for the tension in the screen.

U.S. Pat. No. 4,462,174 discloses a process and apparatus for prestretching screen fabric usable in screen printing. The screen fabric is tensioned using a tensioning device and subsequently an alternating load is applied to the screen fabric to prestretch the screen fabric. The loading may be applied along a direction parallel to, perpendicular to, or at an intermediate angle to the plane of the screen fabric.

U.S. Pat. No. 3,391,635 shows a silk screen printing apparatus having clamping means for uniformly and tightly stretching the screen over a frame by exerting a balancing pushing force on the screen while pulling on the screen with a plurality of hydraulic cylinders arranged around the frame.

Additional examples as shown in U.S. Pat. No. 3,176,843, U.S. Pat. No. 4,373,441 and U.S. Pat. No. 4,430,814.

SUMMARY OF THE INVENTION

The present invention relates to a tensioning apparatus for stretching a screen fabric or other membrane comprising an expandable tensioning frame and an expansion or tensioning means.

The expandable tension frame comprises a first and second pair of substantially parallel frame members held in perpendicular relationship relative to each other by a corresponding plurality of substantially v-shaped corner members to cooperatively form a substantially rectangular configuration. Each frame member is of substantially rectangular configuration having an inner and outer wall held in spaced relationship by an upper and lower wall. A substantially vertical friction wall including a friction surface extends downwardly from each corresponding upper wall to cooperatively form a first and second channel with the inner and outer walls respectively. A screen retainer groove is formed in each corresponding upper wall; while, a screen retainer support surface extends between each corresponding substantially vertical friction wall and corresponding outer wall to cooperatively form a corresponding screen retainer channel therebetween to receive the edge of the screen fabric or other membrane therein.

The expansion or tensioning means comprises at least one expansion or tensioning device comprising a frame member engaging element, a frame member coupling element and an expansion or tensioning actuator. The expansion or tensioning activator comprises an elongated externally threaded member having the frame member engaging element affixed to one end thereof and an actuator knob affixed to the opposite end thereof. The elongated externally threaded member extends through an internally threaded aperture formed through one end portion of the frame member coupling element such that the elongated externally threaded member is substantially perpendicular to the frame member coupling element.

In use, the first and second pair of substantially parallel frame members are placed in perpendicular relationship relative to each other. The substantially v-shaped corner members are then telescopically placed within the first channel of adjacent ends of adjacent frame members to form the substantially rectangular frame. The edge of the screen fabric or other membrane is then placed through the screen retainer grooves. The edge of the screen fabric is retained in the screen retainer channels by a plurality of flat elongated screen retainers. Securing means are threaded through corresponding apertures formed in the inner walls to engage the corresponding second surfaces forcing the corresponding first surfaces into frictional engagement with the corresponding friction surface to prevent movement of the substantially v-shaped corner members relative to the first and second pair of substantially parallel frame members to form a rigid expandable tensioning frame.

To increase the tension of the screen fabric or other membrane, a pair of expansion or tensioning devices are operatively coupled to the same side of the expandable tensioning frame. Specifically, the frame member coupling elements are placed in the corresponding second channels at opposite ends of one of the frame members such that the corresponding frame member engaging element engages the end of the next adjacent frame member disposed at opposite ends of the frame member that house the corresponding frame member coupling elements. The securing means adjacent the corresponding frame member engaging elements are loosened to permit telescopic movement of the corresponding v-shaped corner members in the corresponding first channels. The actuator knobs are rotated forcing the corresponding v-shaped corner members outward relative to the corresponding frame members to increase the tension of the screen fabric or other membrane. The corresponding securing means are then moved inwardly to secure the corresponding substantially v-shaped corner members. This process is continued at the various corners until the screen fabric or other membrane is at the desired tension. The expansion or tensioning device may then be removed for use with another expandable tensioning frame.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a better understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
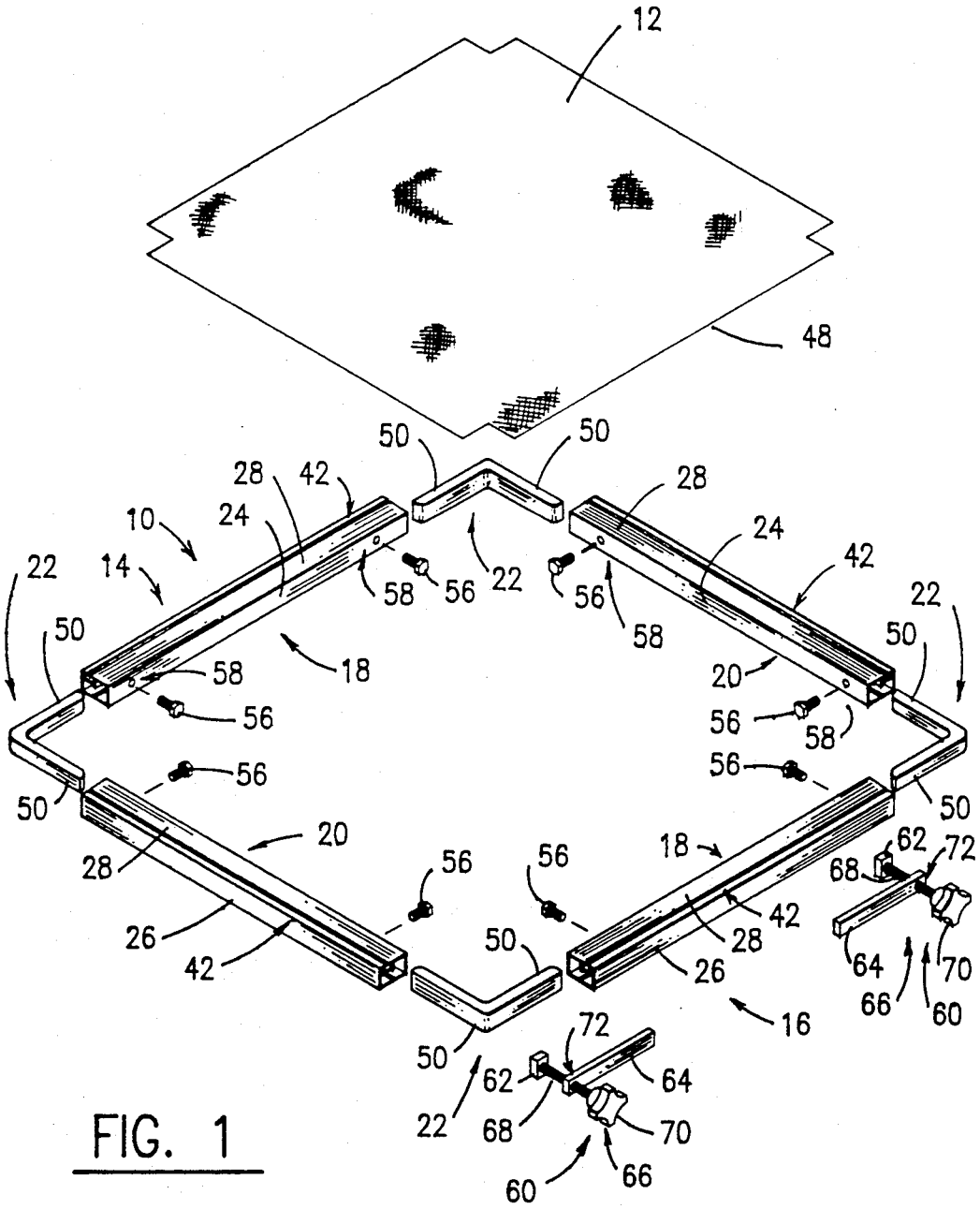
FIG. 1 is an exploded view of the tensioning apparatus.
Figure 3:
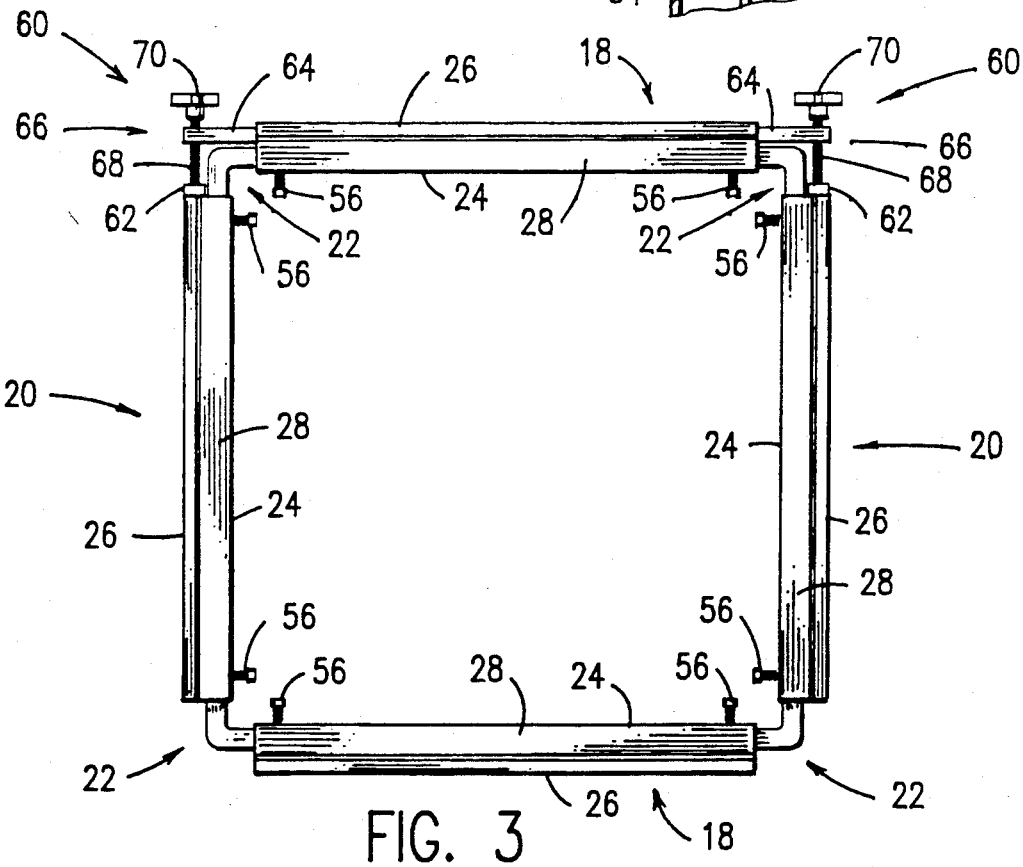
FIG. 3 is a top view of the expandable tensioning frame and the expansion or tensioning means operatively mounted thereon.

As best shown in FIGS. 1 and 3, the present invention relates to a tensioning apparatus generally indicated as 10 for stretching a screen fabric or other membrane 12. More specifically, the tensioning apparatus 10 comprises an expandable tensioning frame generally indicated as 14 and an expansion or tensioning means generally indicated as 16.

Figure 2:
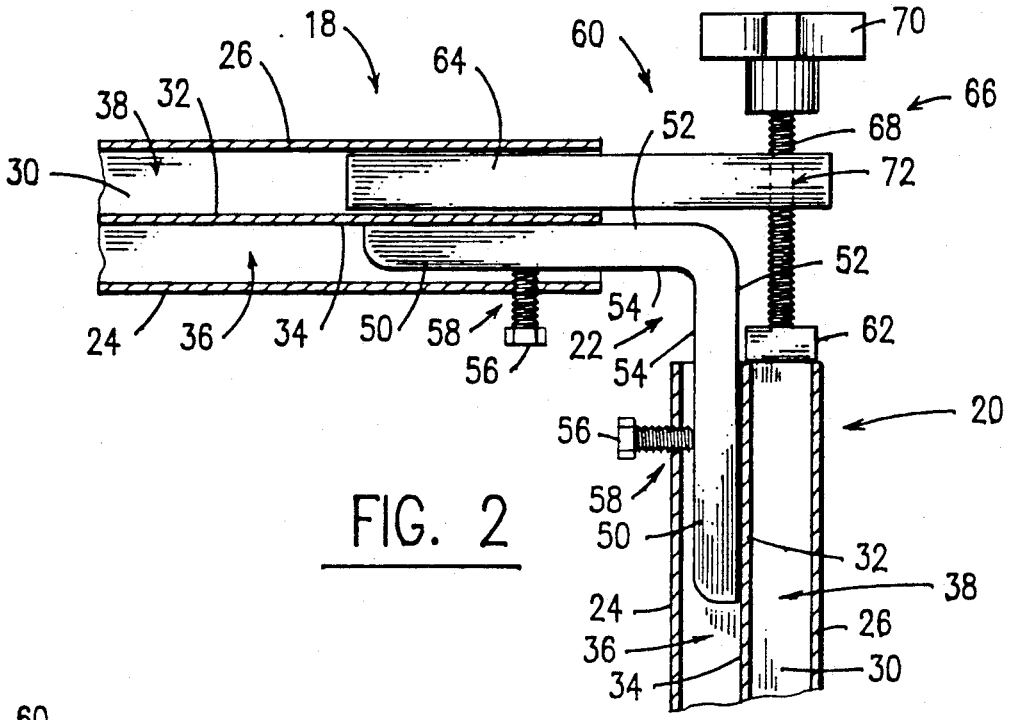
FIG. 2 is a partial cross-sectional top view of a corner of the expandable tensioning frame and the expansion or tensioning means operatively mounted thereon.

As best shown in FIGS. 1 through 3, the expandable tension frame 14 comprises a first pair of substantially parallel frame members each generally indicated as 18 and a second pair of substantially parallel frame members each generally indicated as 20 held in perpendicular relationship relative to the first pair of substantially parallel frame members 18 by a plurality of substantially v-shaped corner members each generally indicated as 22 to cooperatively form a substantially rectangular configuration.

Figure 5:
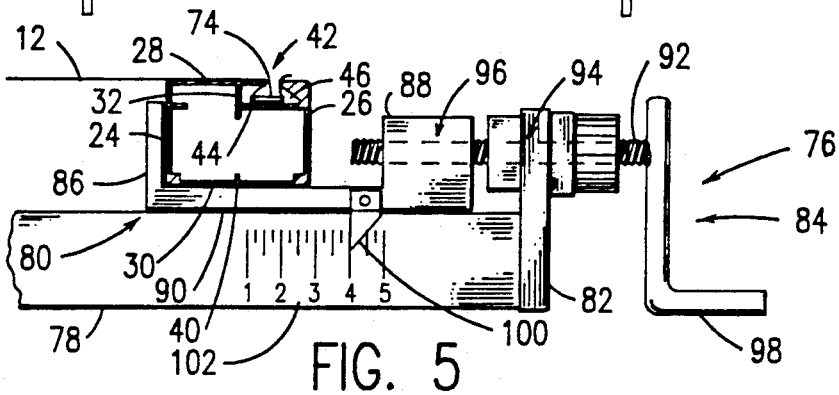
FIG. 5 is a partial cross-sectional view of the frame member and the alternate expansion or tensioning means.

As best shown in FIGS. 1, 2 and 5, each frame member 18 and 20 is of substantially rectangular configuration having an inner and outer wall indicated as 24 and 26 respectively held in spaced relationship by an upper and lower wall indicated as 28 and 30 respectively. A substantially vertical friction wall 32 including a friction surface extends downwardly from the corresponding upper wall 28 to cooperatively from a first and second channel indicated as 36 and 38 respectively with the inner and outer walls 24 and 26 respectively. An alignment element 40 disposed in the same vertical place as the substantially vertical friction wall 32 extends upwardly from each corresponding lower wall 30. A screen retainer groove 42 is formed in each corresponding upper wall 28; while, a screen retainer support surface 44 extends between the corresponding substantially vertical friction wall 32 and corresponding outer wall 26 to cooperatively form a corresponding screen retainer channel 46 therebetween to receive the edge 48 of the screen fabric or other membrane 12 therein. As best shown in FIGS. 1 and 2, each substantially v-shaped corner member 22 comprises a pair of legs each indicated as 50 operatively disposed within the corresponding first channel 36 and having a first and second surface indicated as 52 and 54 respectively. As best shown in FIG. 1, the first surface 52 is held against the corresponding friction surface 34 by a securing means 56 extending through a corresponding aperture 58 formed through the corresponding inner wall 24 to engage the second surface 54 such that the engagement between the first surface 52 and corresponding friction surface 34 prevents relative movement between the substantially v-shaped corner members 22 and corresponding frame members 18 and 20 against the inward compression forces of the stretched screen fabric or other membrane 12 when the securing means 56 is held against the second surface 54 of the corresponding leg 50.

As best shown in FIGS. 1 through 3, the expansion or tensioning means 16 comprises at least one expansion or tensioning device generally indicated as 60. The or tensioning device 60 comprises a frame engaging member 62, a frame member coupling element 64 and an expansion or tensioning actuator generally indicated as 66. The expansion or tensioning activator 66 comprises an elongated externally threaded member 68 having the frame engaging member 62 affixed to one end thereof and an actuator knob 70 affixed to the opposite end thereof. The elongated externally threaded member 68 extends through an internally threaded aperture 72 formed through one end portion of the frame member coupling element 64 such that the elongated externally threaded member 68 is substantially perpendicular to the frame member coupling element 64.

In use, the first and second pair of substantially parallel frame members 18 and 20 are placed in perpendicular relationship relative to each other. The legs 50 of each substantially v-shaped corner members 22 are then telescopically placed within the corresponding first channels 36 of adjacent ends of adjacent frame members 18 and 20 to form a substantially rectangular frame. The edge 48 of the screen fabric or other membrane 12 is then placed through the screen retainer grooves 42. The edge 48 of the screen fabric or other membrane 12 is retained in the screen retainer channels 46 by a plurality of flat elongated screen retainers 74 (FIG. 5). The securing means 56 are threaded through the corresponding apertures 58 to engage the corresponding second surfaces 54 forcing the corresponding first surfaces 52 into frictional engagement with the corresponding friction surfaces 34 to prevent movement to the substantially v-shaped corner members 22 relative to the corresponding first and second pair of substantially parallel frame members 18 and 20 to form the rigid expandable tensioning frame 14.

As shown in FIGS. 1 through 3, to increase the tension of the screen fabric or other membrane 12, a pair of expansion or tensioning devices 60 are operatively coupled to the same side of the expandable tensioning frame 14. Specifically, the frame member coupling element 64 is placed in the corresponding second channel 38 at opposite ends of one of the frame members 18/20 such that the corresponding frame engaging member 62 engages the end of the next adjacent frame member 18/20 disposed at opposite ends of the frame member 18/20 housing the corresponding frame member coupling element 64. The securing means 56 adjacent the corresponding frame member engaging element 62 are loosened to permit telescopic movement of the corresponding leg 50 in the corresponding first channel 36. The actuator knobs 70 are rotated forcing the corresponding legs 50 outward relative to the corresponding frame member 18/20 to increase the tension of the screen fabric or other membrane 12. The corresponding securing means 56 are then moved inwardly to secure the corresponding substantially v-shaped corner members 22. This process is continued at the various corners until the screen fabric or other membrane 12 is at the desired tension. The expansion or tensioning device 60 may then be removed for use with another expandable tensioning frame 14.

Figure 4:
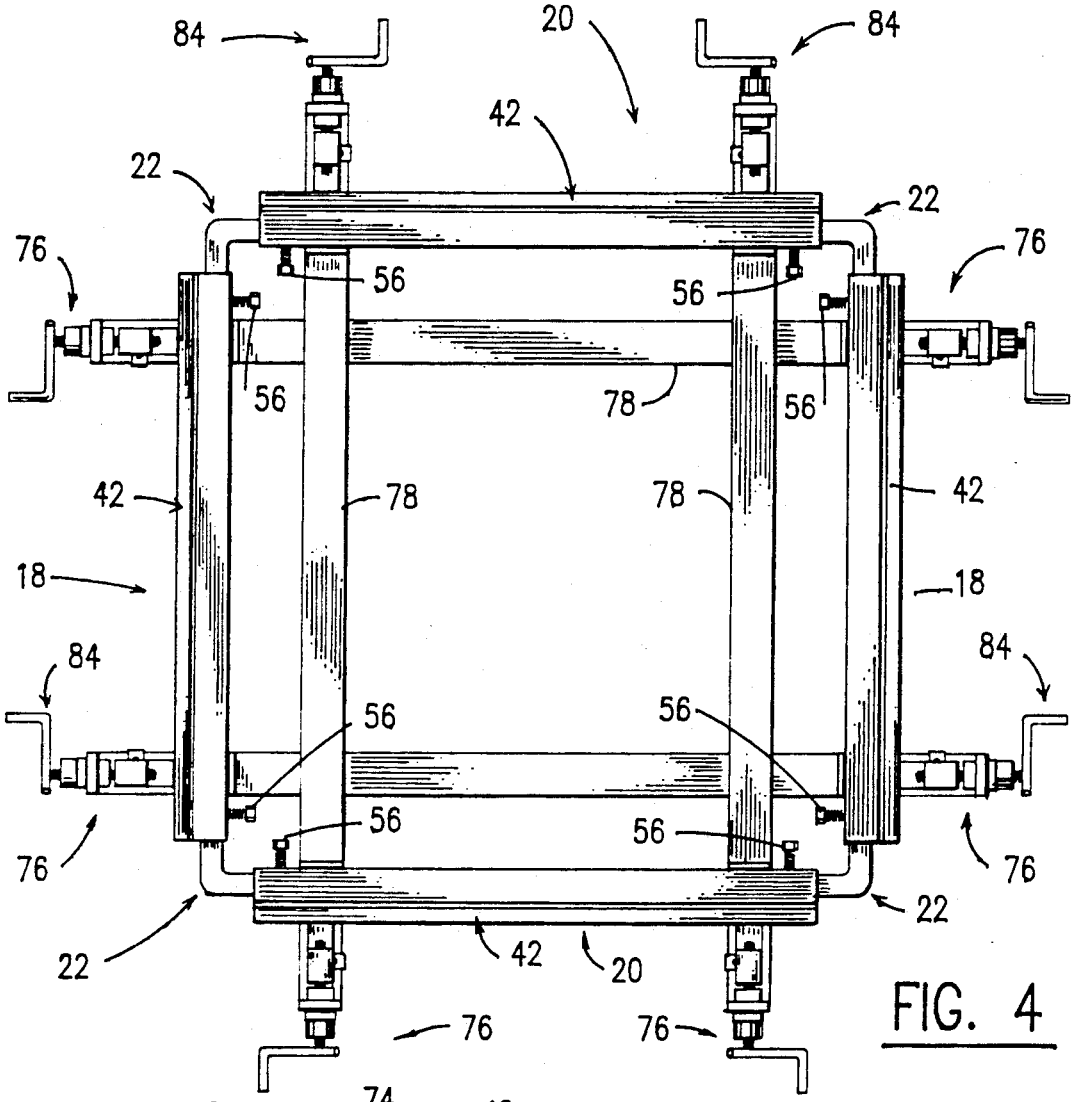
FIG. 4 is a top view of the expandable tensioning frame and an alternate expansion or tensioning means.

FIGS. 4 and 5 show an alternate embodiment of the expansion or tensioning means. Specifically, the expansion or tensioning devices each generally indicated as 76 operatively mounted to a support frame comprising a plurality of support cross members each indicated as 78. As best shown in FIG. 5, each expansion or tension device 76 comprises a frame engaging member generally indicated as 80, a frame member coupling element 82 and an expansion or tensioning actuator generally indicated as 84. Each frame engaging member 80 comprises an inner and outer element indicated as 86 and 88 respectively slidably mounted on the corresponding support cross member 78 by a frame engaging support member 90. Each expansion or tensioning actuator 84 comprises an elongated externally threaded member 92 extending through an internally threaded aperture 94 formed through the frame member coupling element 82 and an internally threaded aperture 96 formed through the outer element 88 of the frame engaging member 80, and an actuator handle 98 affixed to the outer end of the elongated externally threaded member 92. Each expansion or tensioning device further includes an incremental adjustment indicia comprising a pointer 100 affixed to the frame engaging support member 90 and a plurality of markings 102 formed on the side of each support cross member 78.

In use, the screen fabric or other membrane 12 is placed on the expandable tensioning frame 14 as previously described. To increase the tension of the screen fabric or other membrane 12, the actuator handles 98 are selectively rotated to slide the corresponding frame engaging member 80 outward on the corresponding support cross members 78 causing the corresponding frame members 18/20 to move outward under the force of the corresponding inner elements 86. The relative movement of each expansion or tensioning device 76 relative to the corresponding support cross member 78 is indicated by the position of each point 100 relative to the corresponding markings 102.

Figure 8:
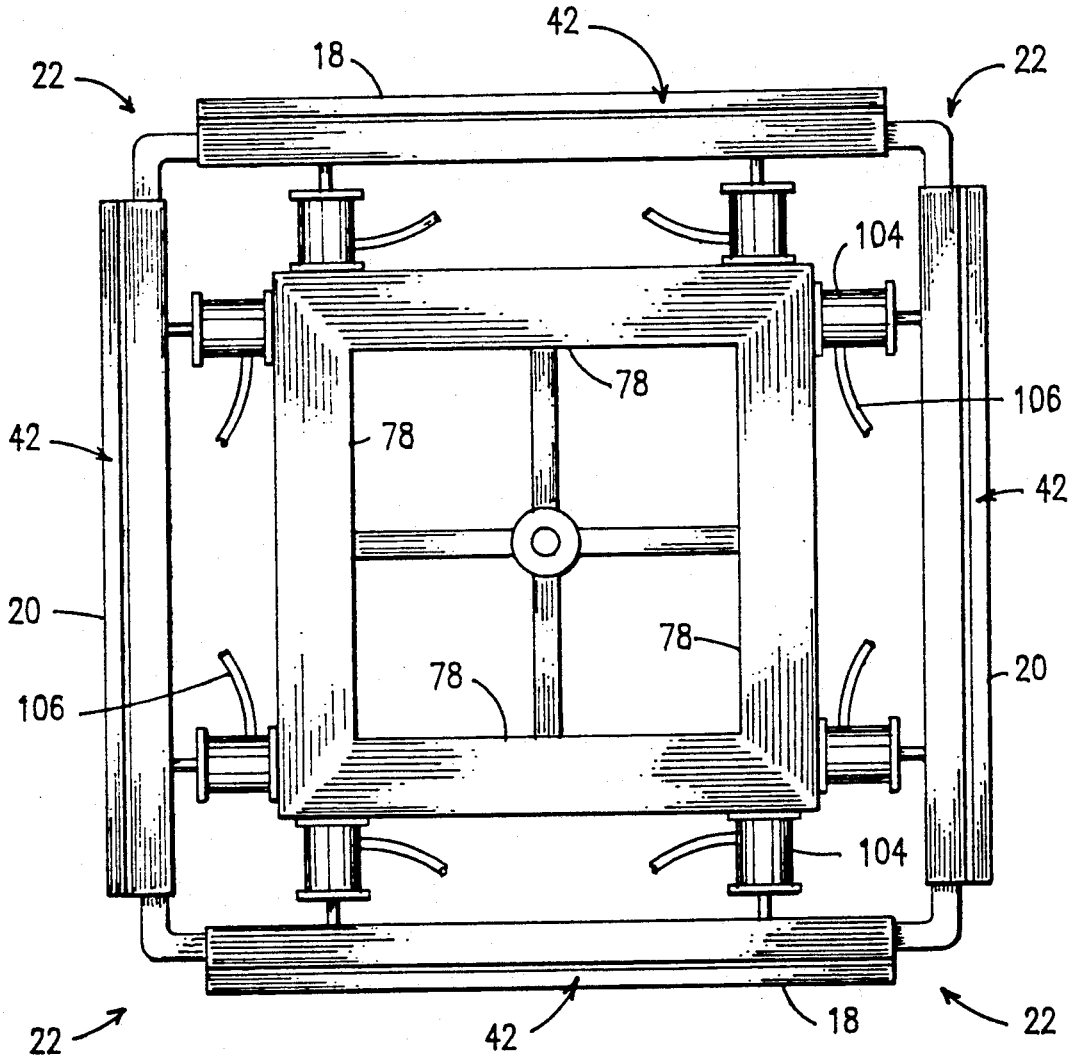
FIG. 8 is a top view of the expandable tensioning frame and another alternate expansion or tensioning means.

Although a manual expansion or tensioning means 74 is shown, a hydraulic or pneumatic means may be used. For example as shown in FIG. 8, each elongated externally threaded member 92 may be replaced by a pneumatic or hydraulic cylinder 104 coupled to remote regulators or solenoid valves (not shown) through fluid lines or conduits 106. This configuration provides a more rapid operation than the manual device. Applied force of the cylinder expansion forces may be programmed. Furthermore, the pneumatic or hydraulic cylinders 104 can increase or decrease fabric tension in linear or stepped increments. Modern screen printing fabrics behave best when tensioned in ascending increments. A pneumatic system (not shown), controlled by a micro processor or simple sequential switch, could alternately expand and relax the fabric to hasten the inducement of the so called work-hardened state of screen printing fabric. U.S. Pat. No. 4,462,174 is to be used for such a purpose.

When a higher degree of sophistication is desired, the expandable tensioning frame 14 may be expanded with a device such as that in FIG. 8. As shown the eight (8) pneumatic cylinders 104 may be operated singly, in pairs, or simultaneously.

Frames of different sizes place various structural demands on the components. It may be necessary to change the corner and the tubing to accommodate those demands when larger frames and higher loads are contemplated. The corner piece may be substantially thickened such that it can reach the outer wall of the tube. In such a case, the friction surface might be attached both to the upper and lower walls, and also to the outer walls.

Figure 6:
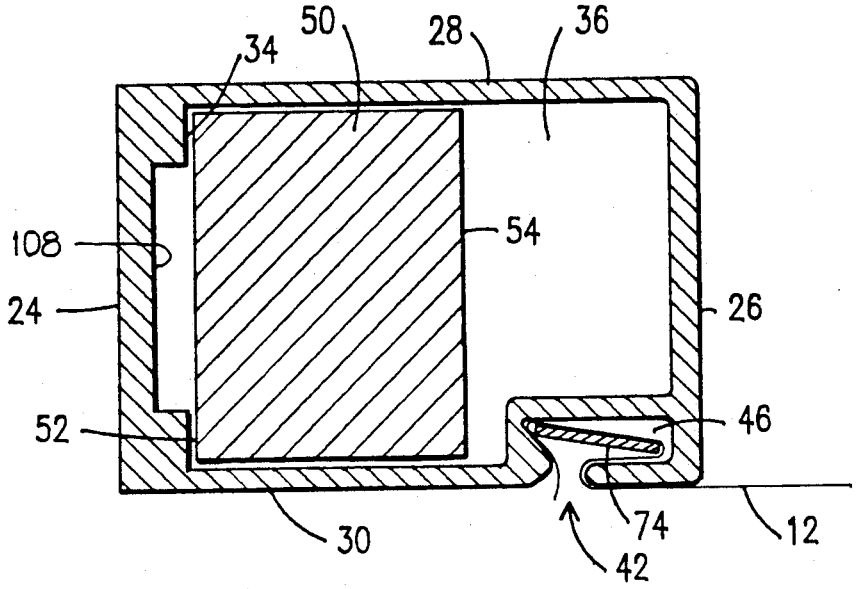
FIG. 6 is a cross-sectional view of an alternate frame member and one of the legs of the substantially v-shaped corner member.

For example, FIG. 6 shows an alternate embodiment of the frame members 18/20. Each frame member 18 and 20 is of substantially rectangular configuration having an inner and outer wall indicated as 24 and 26 respectively held in substantially parallel spaced relationship by an upper and lower wall indicated as 28 and 30 respectively. The inner wall 24 includes a friction surface 34 and recess 108. A screen retainer groove 42 is formed in each corresponding lower wall 30. A corresponding screen retainer channel 46 receives the edge 48 of the screen fabric or other membrane 12 therein. Each leg 50 is operatively disposed within the corresponding first channel 36 and includes a first and second surface indicated as 52 and 54 respectively. The first surface 52 is held against the corresponding friction surface 34 by the securing means 56 extending through a corresponding aperture 58 formed through the corresponding inner wall 24 to engage the second surface 54 such that the engagement between the first surface 52 and corresponding friction surface 34 prevents relative movement between the substantially v-shaped corner members 22 and corresponding frame members 18 and 20 against the inward compression forces of the stretched screen fabric or other membrane 12 when the securing means 56 is held against the second surface 54 of the corresponding leg 50 as shown in FIGS. 2 and 3.

Figure 7:
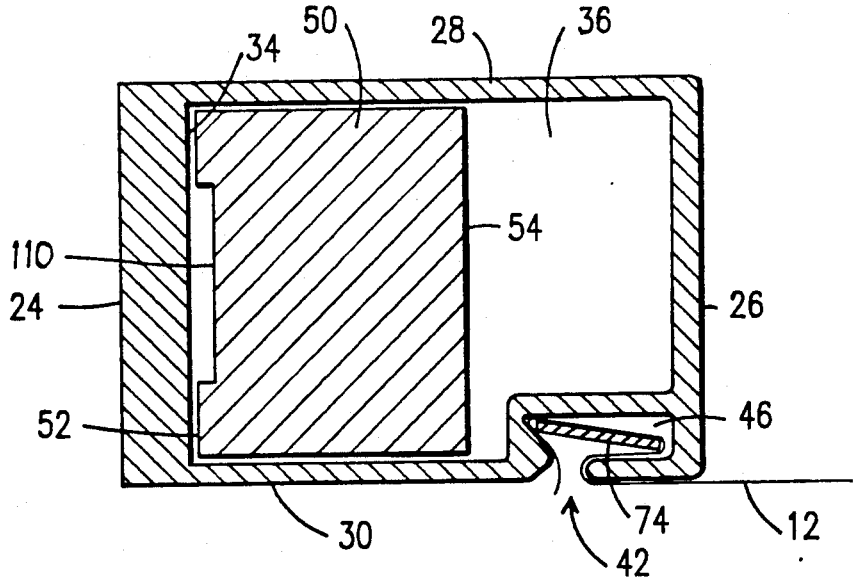
FIG. 7 is a cross-sectional view of another alternate frame member and one of the legs of an alternate substantially v-shaped corner member.

FIG. 7 shows an alternate embodiment of the legs 50. Each frame member 18 and 20 is of substantially rectangular configuration having an inner and outer wall indicated as 24 and 26 respectively held in substantially parallel spaced relationship by an upper and lower wall indicated as 28 and 30 respectively. The inner wall includes a friction surface 34. A screen retainer groove 42 is formed in each corresponding lower wall 30. A corresponding screen retainer channel 46 receives the edge 48 of the screen fabric or other membrane 12 therein. Each leg 50 including a recess 110 is operatively disposed within the corresponding first channel 36 and includes a first and second surface indicated as 52 and 54 respectively. The first surface 52 is held against the corresponding friction surface 34 by the securing means 56 extending through a corresponding aperture 58 formed through the corresponding inner wall 24 to engage the second surface 54 such that the engagement between the first surface 52 and corresponding friction surface 34 prevents relative movement between the substantially v-shaped corner members 22 and corresponding frame members 18 and 20 against the inward compression forces of the stretched screen fabric or other membrane 12 when the securing means 56 is held against the second surface 54 of the corresponding leg 50 as shown in FIGS. 2 and 3.

The primary purpose is for screen printing. However, the expandable tensioning frame is useful in other areas such as sifting, filtering or granular grading etc. The expandable tensioning frame 14 is also being used to tension mylar film that is used in planar audio speaker systems. The expandable tensioning 14 frame has potential for diverse uses such as seating support for chairs, modern furniture such as reception room tables, diffusion screens for photographic lighting, osmotic filter holders, rear projection film reflector supports for video use, and front or rear projection indoor/outdoor signs. In these and other applications, selectable tension of the membrane is an essential capability. Moreover the expandable tension frame 14 can be used as an exercise trampoline, a flyback device for baseball pitching practice with a non-permeable membrane with suitable curved edges to form a cavity, as well as used in hospitals, physical therapy installations and agricultural shade screens.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tensioning apparatus for stretching screen fabric comprising an expandable tensioning frame formed by a plurality of cooperative frame members having means for gripping said fabric and a plurality of corner members cooperating with said frame members to operatively support the screen fabric thereon, each frame member includes a first channel having a frictional surface therein, each corner member includes first and second legs, each leg being telescopically disposed within a corresponding first channel of an adjacent end of an adjacent frame member to slidingly engage said frictional surface formed in said corresponding first channel, a plurality of securing means, each securing means secures each leg to said corresponding channel, and each said securing means is movable between a first and second position to selectively engage or disengage said legs to or from said corresponding channels each leg includes a first and second surface, said first surface being held against said corresponding frictional surface by engaging said second surface with said securing means such that engagement between said first surfaces and said corresponding frictional surfaces prevents relative movement between said corner members and said frame members against an inward compression force of the stretched screen fabric when said securing means is in said first position.

2. The tensioning apparatus of claim 1 wherein each frictional surface includes at least one recess formed thereon.

3. The tensioning apparatus of claim 1 wherein each first surface of each leg includes at least one recess formed thereon.

4. A tensioning apparatus for stretching screen fabric comprising an expandable tensioning frame formed by a plurality of cooperative frame members having means for gripping said fabric and a plurality of corner members cooperating with said frame members to operatively support the screen fabric thereon, each frame member includes a first channel having a frictional surface therein, each corner member includes first and second legs, each leg being telescopically disposed within a corresponding first channel of an adjacent end of an adjacent frame member to slidingly engage said frictional surface formed in said corresponding first channel, a plurality of securing means, each securing means secures each leg to said corresponding channel, each said securing means is movable between a first and second position to selectively engage or disengage said legs of said corner members, when in said first position, said securing means secures said legs of said corner members in frictional engagement with said corresponding frictional surfaces of said frame members to prevent movement of said legs relative to said frame members, and an expansion means including at least one expansion device movable between a first and second position to selectively move at least one of said frame members relative to at least one of said adjacent frame members when said securing means is disengaged in said second position as said expansion device is moved between said first and second positions, and each frame member includes an inner and outer wall in spaced relationship to each other and an upper and lower wall and said frictional surface includes a frictional wall extending between said upper and lower walls.

5. The tensioning apparatus of claim 4 wherein each frictional wall and inner and outer walls cooperatively form first and second channels.

6. The tensioning apparatus of claim 5 wherein said expansion device comprises a frame member coupling element placed in one of said second channels at one end of one of said frame members and a frame engaging member for engaging the end of an adjacent frame member and an expansion actuator movable between a first and second position coupled between said frame member coupling element and said frame engaging member for moving said frame coupling element relative to said frame engaging member when moved between said first and second position to move said adjacent frame members relative to each other when said securing means is disengaged in said second position for telescopic movement of said corresponding leg in said corresponding first channel.

7. The tensioning apparatus of claim 6 wherein said expansion actuator comprises an elongated externally threaded member having said frame member engaging element affixed to one end thereof and an actuator knob affixed to an opposite end thereof, said elongated externally threaded member extending through an internally threaded aperture formed through one end portion of said frame member coupling element.

8. The tensioning apparatus of claim 7 wherein said expansion means comprises an expansion device operatively coupled to opposite ends of one of said frame members.

9. The tensioning apparatus of claim 7 wherein said expansion means comprises an expansion device operatively coupled to opposite ends of each of said frame members.

10. A tensioning apparatus for stretching screen fabric comprising an expandable tensioning frame formed by a plurality of cooperative frame members having means for gripping said fabric and a plurality of corner members cooperating with said frame members to operatively support the screen fabric thereon, each frame member includes a first channel having a frictional surface therein, each corner member includes first and second legs, each leg being telescopically disposed within a corresponding first channel of an adjacent end of an adjacent frame member to slidingly engage said frictional surface formed in said corresponding first channel, a plurality of securing means, each securing means secures each leg to said corresponding channel, and each said securing means is movable between a first and second position to selectively engage or disengage said legs of said corner members, when in said first position, said securing means secures said legs of said corner members in frictional engagement with said corresponding frictional surfaces of said frame members to prevent movement of said legs relative to said frame members, and an expansion means including a support frame having at least one expansion device mounted thereon movable between a first and second position to selectively move at least one of said frame members relative to at least one of said adjacent frame members when said securing means is disengaged in said second position as said expansion device is moved between said first and second positions.

11. The tensioning apparatus of claim 10 wherein said expansion device comprises a frame member coupling element and a frame engaging member for engaging one of said frame members and an expansion actuator movable between a first and second position coupled between said frame engaging element and said frame engaging member for moving said frame coupling member relative to said frame coupling element member when moved between said first and second position to move said adjacent frame members relative to each other when said securing means is disengaged in said second position for telescopic movement of said corresponding leg in said first channel.

12. The tensioning apparatus of claim 11 wherein said expansion actuator comprises an elongated externally threaded member extending through an internally threaded aperture formed through said frame member coupling element and an internally threaded aperture formed through an outer element of said frame engaging member, and an actuator handle affixed to an outer end of said elongated externally threaded member.

13. The tensioning apparatus of claim 10 wherein said expansion device further includes an incremental adjustment indicia to provide a visual indication of a position of said frame member engaging element relative to said support frame.

14. The tensioning apparatus of claim 13 wherein said incremental adjustment indicia comprises a pointer affixed to said frame engaging coupling member and a corresponding plurality of markings formed on said support frame.

* * * * *